US008096782B2

(12) United States Patent
McCarthy

(10) Patent No.: US 8,096,782 B2
(45) Date of Patent: Jan. 17, 2012

(54) MULTISTAGE SEALED COOLANT PUMP

(76) Inventor: James McCarthy, Centerville, OH (US)

( * ) Notice: Subject to any disclaimer, the term of this patent is extended or adjusted under 35 U.S.C. 154(b) by 203 days.

(21) Appl. No.: 11/379,388

(22) Filed: Apr. 20, 2006

(65) Prior Publication Data

US 2006/0182641 A1 Aug. 17, 2006

(51) Int. Cl.
*F04B 39/02* (2006.01)

(52) U.S. Cl. ..... 417/366; 417/244; 378/200

(58) Field of Classification Search ..... 417/313, 417/366, 423.5, 369, 370, 244, 251, 368, 417/371, 423.3, 423.8; 378/199, 200
See application file for complete search history.

(56) References Cited

U.S. PATENT DOCUMENTS

| | | | |
|---|---|---|---|
| 1,476,776 | A | 12/1923 | Stamm et al. |
| 2,814,254 | A | 11/1957 | Litzenberg |
| 2,830,541 | A | 4/1958 | Higgins et al. |
| 2,937,908 | A | 5/1960 | Golten |
| 3,399,000 | A | 8/1968 | Remmers |
| 3,420,184 | A | 1/1969 | Englesberg et al. |
| 3,439,961 | A | 4/1969 | Stiles |
| 3,502,920 | A | 3/1970 | Chaboseau |
| 3,891,282 | A | 6/1975 | Tuffias |
| 3,941,437 | A | 3/1976 | MacInnes et al. |
| 3,951,573 | A | 4/1976 | Dunning et al. |
| 3,955,860 | A | 5/1976 | Menke et al. |
| 4,013,384 | A | 3/1977 | Oikawa |
| 4,047,847 | A | 9/1977 | Oikawa |
| 4,054,293 | A | 10/1977 | Hoeg et al. |
| 4,082,380 | A | 4/1978 | Klaus et al. |
| 4,105,372 | A | 8/1978 | Mishina et al. |
| 4,123,675 | A | 10/1978 | Moskowitz et al. |
| 4,171,818 | A | 10/1979 | Moskowitz et al. |
| 4,200,296 | A | 4/1980 | Stahl et al. |
| 4,229,142 | A | 10/1980 | Le Dall et al. |
| 4,254,961 | A | 3/1981 | Fersht et al. |
| 4,407,508 | A | 10/1983 | Raj et al. |
| 4,444,398 | A | 4/1984 | Black, Jr. et al. |
| 4,493,610 | A | 1/1985 | Iino et al. |
| 4,526,484 | A | 7/1985 | Stahl et al. |
| 4,630,943 | A | 12/1986 | Stahl et al. |
| 4,694,213 | A | 9/1987 | Gowda et al. |
| 4,717,266 | A | 1/1988 | Hart, Jr. et al. |
| 4,764,085 | A | 8/1988 | Jesinger |
| 4,795,275 | A | 1/1989 | Titcomb et al. |
| 4,797,013 | A | 1/1989 | Raj et al. |
| 4,808,070 | A | 2/1989 | Fonda-Bonardi |
| 4,809,354 | A | 2/1989 | Kawashima |
| 4,830,384 | A | 5/1989 | Raj et al. |
| 4,890,850 | A | 1/1990 | Raj et al. |
| 4,898,480 | A | 2/1990 | Raj et al. |
| 4,938,611 | A | 7/1990 | Nii et al. |
| 4,967,831 | A | 11/1990 | Leland |
| 4,969,803 | A | 11/1990 | Turanskyj |
| 5,005,639 | A | 4/1991 | Leland |

(Continued)

*Primary Examiner* — Devon C Kramer
*Assistant Examiner* — Leonard Weinstein
(74) *Attorney, Agent, or Firm* — Jacox, Meckstroth & Jenkins

(57) ABSTRACT

A multistage sealed pump is provided for use in an X-ray tube cooling system which is substantially more efficient than pumps of known construction and which provides substantially higher pumping pressure at lower motor current than conventionally. Cooling liquid can be transferred from stage to stage by interconnecting tubing external of the housing or within the housing, through a hollow motor shaft, or through the motor casing. In another embodiment, the multiple impellers can be directly mounted on a shaft extending from a single end of the motor.

3 Claims, 6 Drawing Sheets

U.S. PATENT DOCUMENTS 5,007,513 A 4/1991 Carlson
5,108,198 A 4/1992 Nii et al.
5,110,141 A 5/1992 Dayan
5,112,142 A 5/1992 Titcomb et al.
5,161,900 A 11/1992 Bougathou et al.
5,215,448 A 6/1993 Cooper
5,238,254 A 8/1993 Takii et al.
5,261,796 A * 11/1993 Niemiec et al. ..... 417/371
5,378,121 A 1/1995 Hackett
5,433,529 A 7/1995 Hensel
5,463,511 A 10/1995 Nakano et al.
5,524,985 A 6/1996 Dunfield
5,555,956 A * 9/1996 Voss et al. ..... 184/6.16
5,598,908 A 2/1997 York et al.
5,616,973 A 4/1997 Khazanov et al.
5,641,275 A 6/1997 Klein et al.
5,660,397 A 8/1997 Holtkamp
5,675,199 A 10/1997 Miyakoshi et al.
RE35,718 E 1/1998 Nii et al.
5,704,613 A 1/1998 Holtkamp
5,757,097 A 5/1998 Sato
5,888,053 A * 3/1999 Kobayashi et al. ..... 417/244
5,954,342 A 9/1999 Mikhalev et al.
5,956,204 A 9/1999 Dunfield et al.
5,969,903 A 10/1999 Parsoneault et al.
6,036,435 A 3/2000 Oklejas
6,055,126 A 4/2000 Kennedy et al.
6,062,028 A 5/2000 Arnold et al.
6,074,092 A 6/2000 Andrews
6,155,802 A * 12/2000 Choi et al. ..... 417/366
6,285,527 B1 9/2001 Kennedy et al.
6,305,694 B1 10/2001 Yamazumi et al.
6,375,438 B1 4/2002 Seo
6,422,838 B1 * 7/2002 Sloteman ..... 417/423.5
6,547,438 B2 4/2003 Shima
6,626,649 B2 9/2003 Cowans
6,717,308 B2 4/2004 Chen et al.
6,899,338 B2 5/2005 Li et al.
7,048,520 B1 5/2006 McCarthy
7,129,609 B1 10/2006 Mikhalev et al.

* cited by examiner

FIG. 1
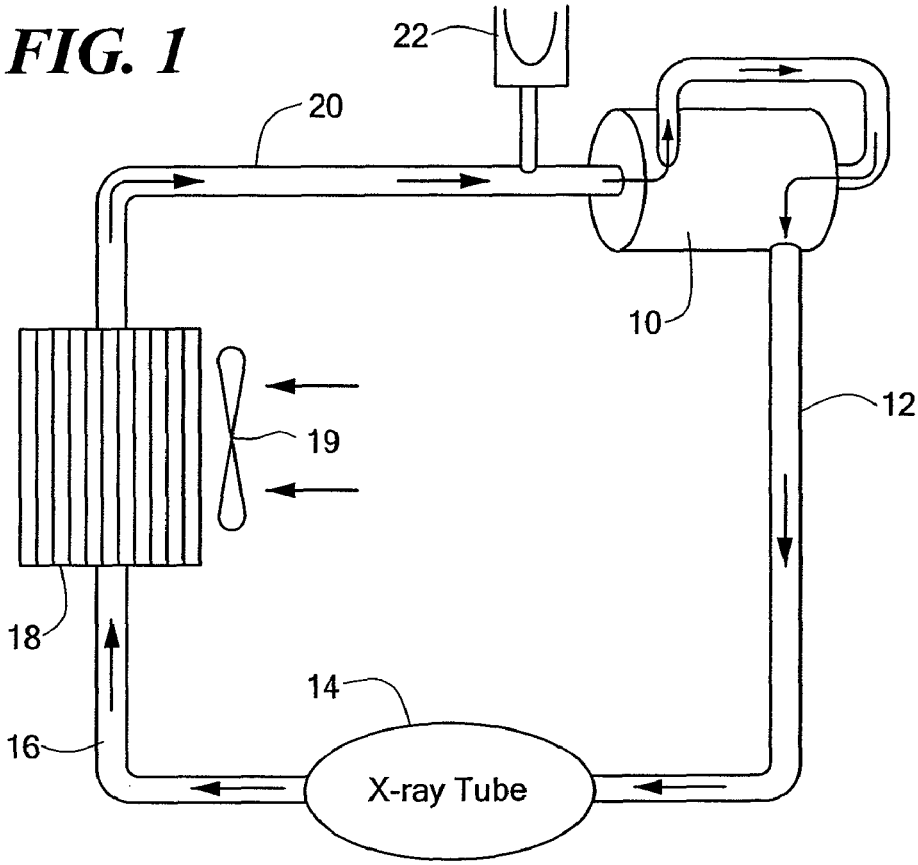
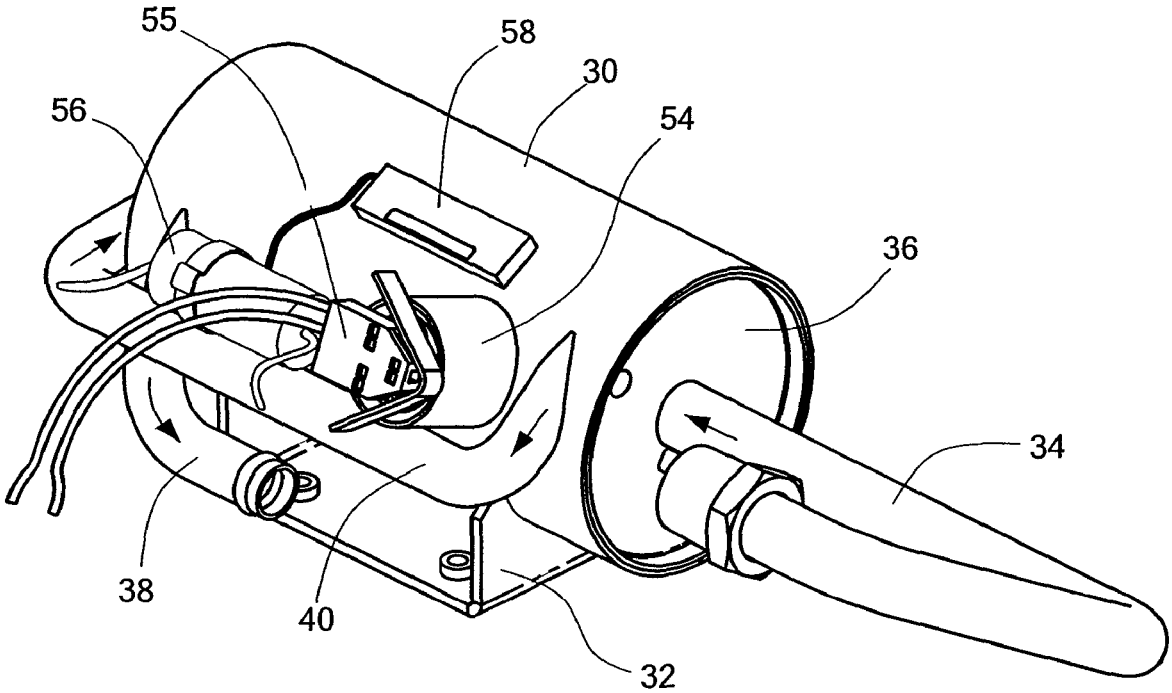
FIG. 2

MULTISTAGE SEALED COOLANT PUMP

CROSS REFERENCE TO RELATED APPLICATIONS

This application claims priority of U.S. patent application Ser. No. 10/413,062, filed Apr. 14, 2003, which is a non-provisional application of U.S. Provisional Patent Application No. 60/372,964 entitled MULTISTAGE HERMETICALLY SEALED, DIRECT DRIVE CENTRIFUGAL PUMP, filed on Apr. 16, 2002 the disclosure of both of which are incorporated by reference herein and made a part hereof.

BACKGROUND OF THE INVENTION

This invention relates to coolant pumps and more particularly, to a multistage sealed direct drive centrifugal pump which is especially useful in X-ray tube cooling systems.

For the cooling of an X-ray tube such as used in a CT system, a coolant liquid is circulated around the X-ray tube to cool the tube during use. A pump is employed to circulate the coolant in a cooling system and X-ray system specifications require that the pump have stringent characteristics to be properly employed in the X-ray system. More particularly, the pump must be hermetically sealed, have no shaft seals, add minimal heat to the cooling system, run clean and contaminant free over an extended period of time, produce minimal electrical noise, and be of minimal weight and physical size. In addition, the pump is exposed to high G forces due to rotation of the CT machine and it would therefore be desirable to have a pump of small size and weight.

A known pump for cooling X-ray tubes employs a single impeller to propel the coolant around the X-ray tube. Gear pumps are also known for X-ray tube cooling. A single stage pump has a relatively large diameter impeller to generate the requisite pressure, and the disk friction of the impeller is relatively high by reason of the large diameter. As a consequence, known single impeller pumps have lower efficiency. In addition, the large diameter impeller increases the thrust of the impeller on the motor shaft on which it is mounted and therefore the motor bearings must be sufficient to handle the increased thrust or motor life can be reduced because of the relatively higher thrust. The cooling requirements have increased with increasing X-ray tube power and performance and thereby require increased coolant pumping flow rates and pressure to achieve intended cooling performance. It is therefore desirable to provide a pump providing higher flow rate and pressure than present pumps while providing the necessary characteristics required for use in an X-ray cooling system.

BRIEF SUMMARY OF THE INVENTION

In accordance with the present invention, a multistage sealed pump is provided for use in an X-ray tube cooling system which is substantially more efficient than pumps of known construction and which provides substantially higher pumping pressure at lower motor current and longer life. The pump employs multiple impellers which are plumbed in series and which are directly coupled to an electrical motor which with the impellers is submerged and runs in the coolant liquid. The impellers and motor are sealed within a housing and the pump unit is hermetically sealed, with no rotatable shaft seals being used or required. The multiple stages of the pump yield higher hydraulic efficiency than a single stage pump with the same performance. In addition, higher power motors can be employed in a smaller physical space since the motor windings are more effectively cooled while submerged in the coolant liquid, in contrast to a motor running in air.

In one embodiment, the multistage pump employs a motor having oppositely extending motor shaft ends, with one or more impellers on each end of the motor shaft. This embodiment has the advantage of balancing the thrust of the impellers and thereby reducing the load on the motor bearings, with consequent increased pump life. The cooling liquid can be transferred from stage to stage by various fluid paths. In one aspect of the invention, coolant is conveyed from stage to stage by interconnecting tubing external of the housing. In another aspect of the invention, coolant is conveyed between stages through a hollow motor shaft. In yet another aspect, coolant is transported through tubing within the pump housing. In a further aspect, the coolant is conveyed between stages through the motor casing. In another embodiment, the multiple impellers can be directly mounted on a shaft extending from a single end of the motor.

BRIEF DESCRIPTION OF DRAWINGS

The invention will be more fully understood from the following detailed description in conjunction with the drawings in which:

FIG. 1 is a diagrammatic illustration of an X-ray tube cooling system employing a multistage pump in accordance with the invention;

FIG. 2 is a pictorial view of a pump in accordance with a preferred embodiment of the invention;

DETAILED DESCRIPTION OF THE INVENTION

Figure 3:
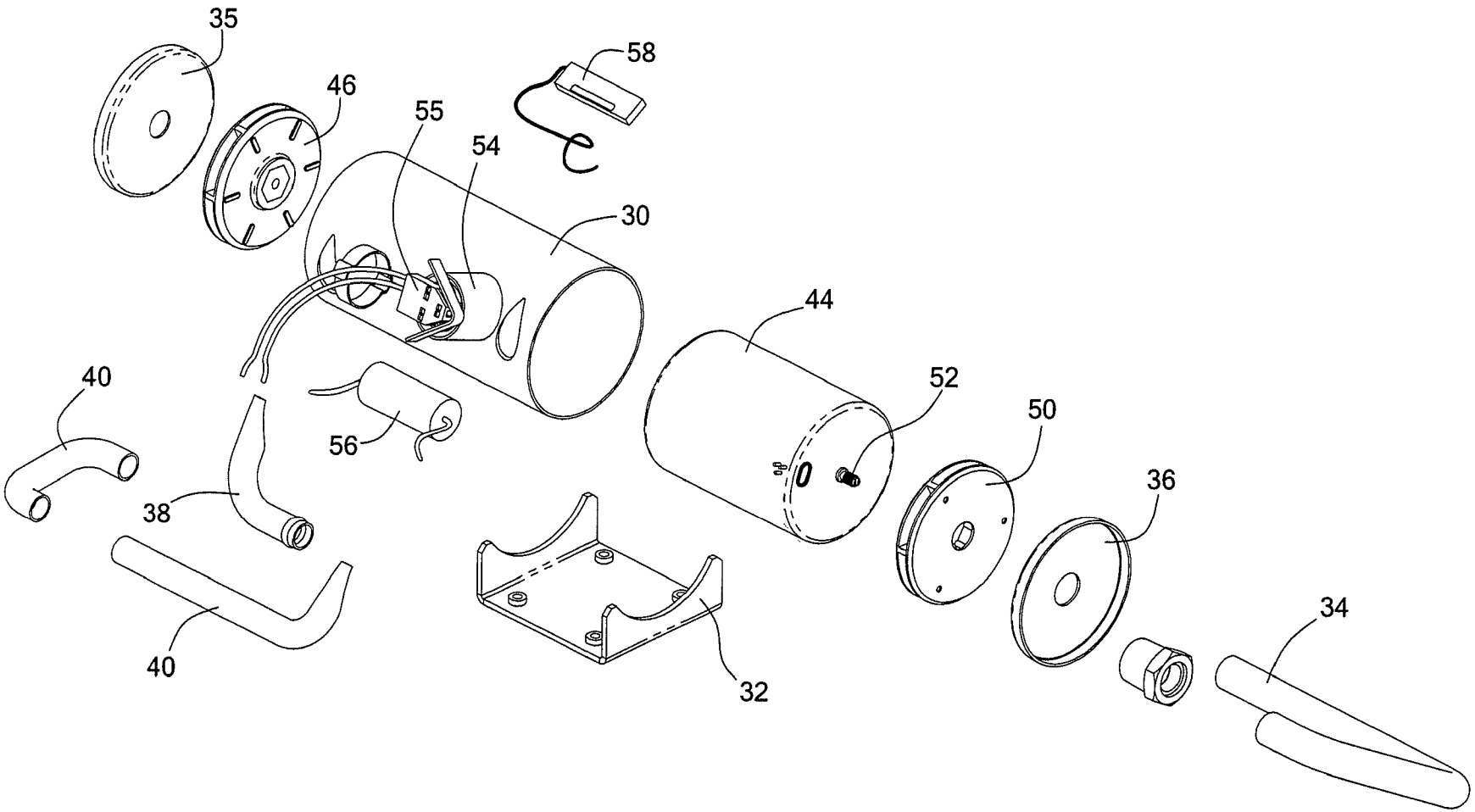
FIG. 3 is an exploded view of the components of the pump of FIG. 2.

An X-ray tube cooling system having a pump in accordance with the invention is shown diagrammatically in FIG. 1. A pump 10 constructed according to the invention and to be further described below, has its output coupled via tubing 12 to a housing 14 of an X-ray tube, and via tubing 16 to a heat exchanger 18, and thence via tubing 20 to the input of pump 10. The system contains a coolant liquid which typically is an oil such as Shell Diala. An expansion tank 22 is provided for accommodating expansion of the coolant as it is heated during use of the X-ray tube. Flow rates of about 8 gallons per minute or higher are typical for coolant flow in a CT system in which the X-ray tube is employed.

Figure 4:
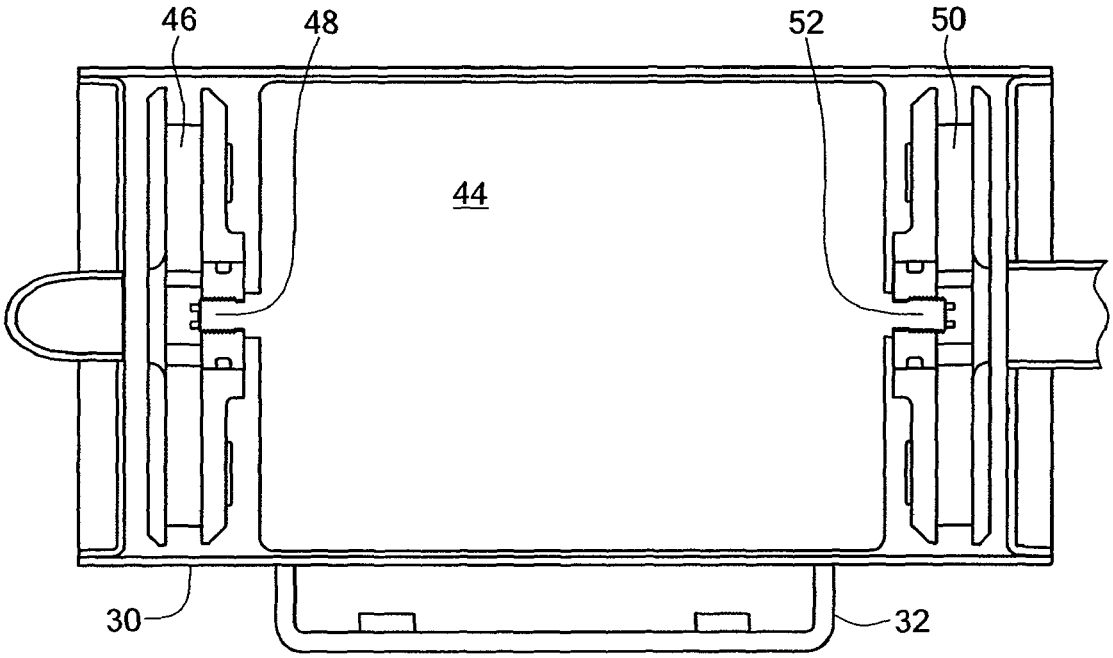
FIG. 4 is a cutaway side view of the pump of FIG. 2.

The pump is shown in a preferred embodiment in FIGS. 2-4 and comprises a cylindrical housing 30 attached to a base or mounting bracket 32 for attaching the housing 30 to a mounting surface. An inlet tube 34 is connected at one end to one end cap 36 of the housing and is welded or otherwise sealingly attached to the end cap 36 to provide for leak proof flow of coolant into the pump housing. An outlet tube 38 is attached near the end of the housing opposite to the inlet tube 34 and is welded or otherwise sealingly attached to the housing 30 to provide for leak proof flow of coolant from the pump housing. Tubing 40 is connected to the end cap 35 and the housing as illustrated to provide a cooling fluid path between the two impellers disposed within the housing.

An electrical motor 44 having an axially extending motor shaft at each end thereof is disposed within the housing 30. The motor is tack-welded to the housing and an epoxy bead is provided between the outer surface of the motor case and the confronting inner surface of the housing. The bead provides a seal to prevent coolant leakage between stages of the pump. Flow between stages is only by way of the intended flow path. A first impeller 50 is mounted on one motor shaft end 52 for rotation therewith, and a second impeller 46 is mounted on the opposite motor shaft 48 for rotation therewith. The impellers 50, 46 can be of any known construction to provide propulsion of coolant supplied thereto. Typically, each impeller includes a pair of disks between which an array of blades are disposed and operative during rotation of the impeller to propel the coolant. The electrical motor 44 and impellers 50, 46 are sealed within the housing and during operation are submerged and run in the coolant. Electrical leads of an electrical connector 54 are hermetically sealed in openings through the housing 30 and provide electrical connection between the motor within the housing 30 and an external supply of electrical power via a mating connector 55 and wires. A motor capacitor 56 is mounted on the exterior of the housing 30. A coulometer 58 can, if desired, also be mounted on the exterior of the housing 30 for the purpose of measuring current flow as a means of measuring operating time for the pump. The manner of providing electrical connection to the motor can be alternatively provided in any known manner to deliver power to the motor. The motor capacitor may be variously mounted, or may be within the motor case. The motor is typically an AC motor operating at standard electrical voltage of 110 volts or 220 VAC and can be single phase or three phase. Alternatively, the motor can be a brushless DC motor.

In operation, the pump is connected to the cooling system as in FIG. 1 and coolant liquid is supplied to the system to fill the pump housing 30, interconnecting tubing and heat exchanger. The coolant flows with the pump housing 30 via inlet tube 34 and flows out of the pump housing 30 from outlet tube 38. Cooling fluid is conveyed in series from the outlet of one impeller stage to the inlet of the next impeller stage via tubing 40. The novel pump provides higher efficiency in comparison to a conventional single stage pump. The illustrated two stage pump in one embodiment provides 25.9 psi of pump pressure at a motor current of 2.94 amps. In contrast, a single stage pump using the same electrical motor provides 17.4 psi at a motor current of 3.6 amps. The resultant improvement in pump efficiency is 39% for the two stage pump versus 23.5% for the single stage pump.

Figure 5:
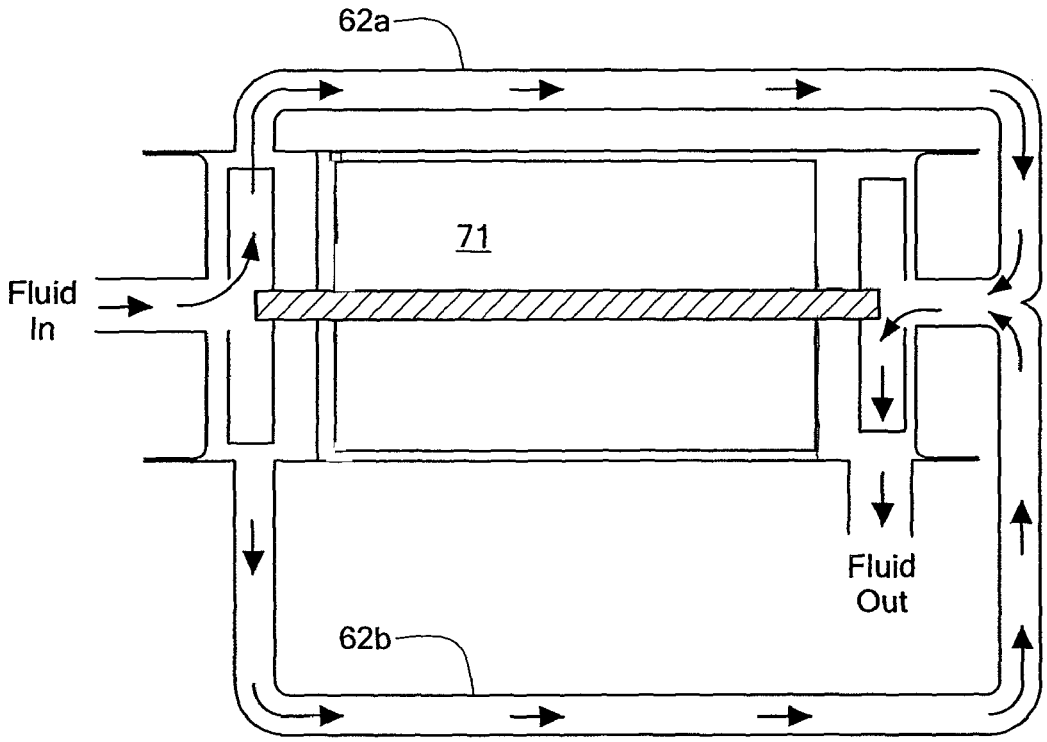
FIG. 5 is a cutaway side view of an alternative embodiment illustrating multiple external interconnecting tubing.

In an alternative embodiment, more than one tube can be employed to couple the coolant in series from one impeller stage to the next. As shown in FIG. 5, first and second tubes 62*a* and 62*b* are provided to interconnect the output of one impeller to the input of the next impeller. Coolant is caused to flow from the first impeller through both interconnecting tubes 62*a* and 62*b* to the second impeller and thence out of the fluid outlet of the housing. In this implementation, the inlet to the second impeller is via a port in the end cap of the housing.

The embodiments of FIGS. 2 and 5 described above enjoy the benefits of balanced thrust. The outlet of the first stage is coupled to the inlet of the second stage which is on the opposite end of the motor from the first stage, as evident in FIG. 2 and FIG. 5. The axial thrusts are substantially of equal magnitude but of opposite direction and therefore the resultant axial thrust is substantially zero. As a consequence, the motor bearings are not subject to increased thrust due to coolant flow.

Figure 6:
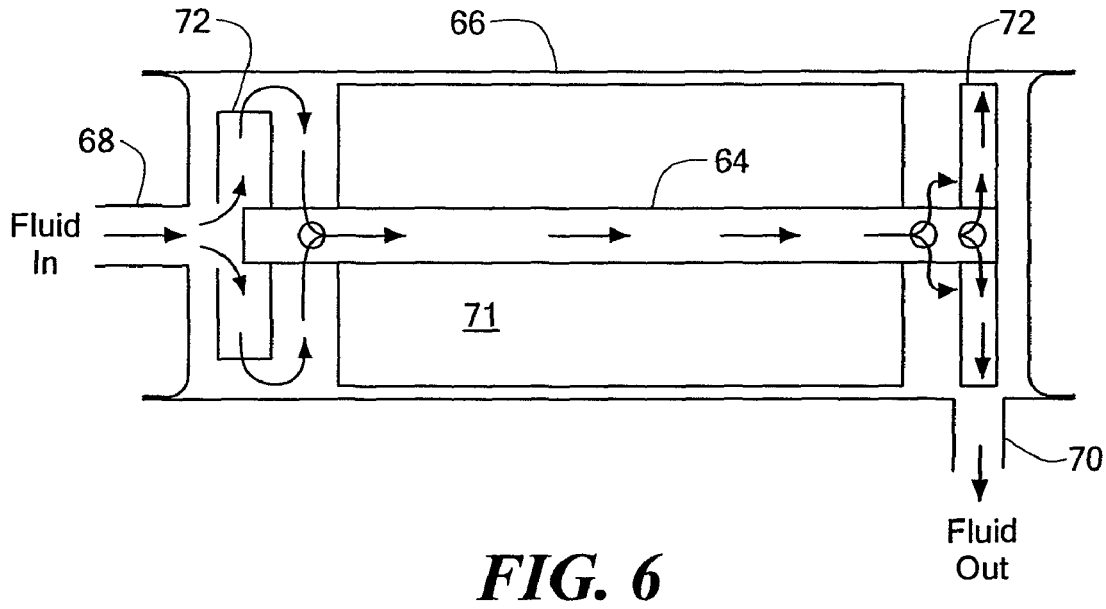
FIG. 6 is a cutaway side view of a further embodiment having a hollow motor shaft for transfer of coolant.

Referring to FIG. 6, an alternative embodiment of the invention is shown in which the motor has a double ended shaft 64 which is hollow and through which coolant can flow. The electrical motor is sealed within a housing 66 having a fluid inlet 68 on one end and a fluid outlet 70 on the opposite end. An impeller 72 is provided on each motor shaft end as in the above described embodiment. In this embodiment however, fluid flowing into the inlet 68 is pumped by the first impeller into openings through the hollow motor shaft 64 and thence through the hollow shaft to the opposite end where the fluid flows out of similarly provided openings for propulsion by the second impeller out of the fluid outlet 70.

Figure 7:
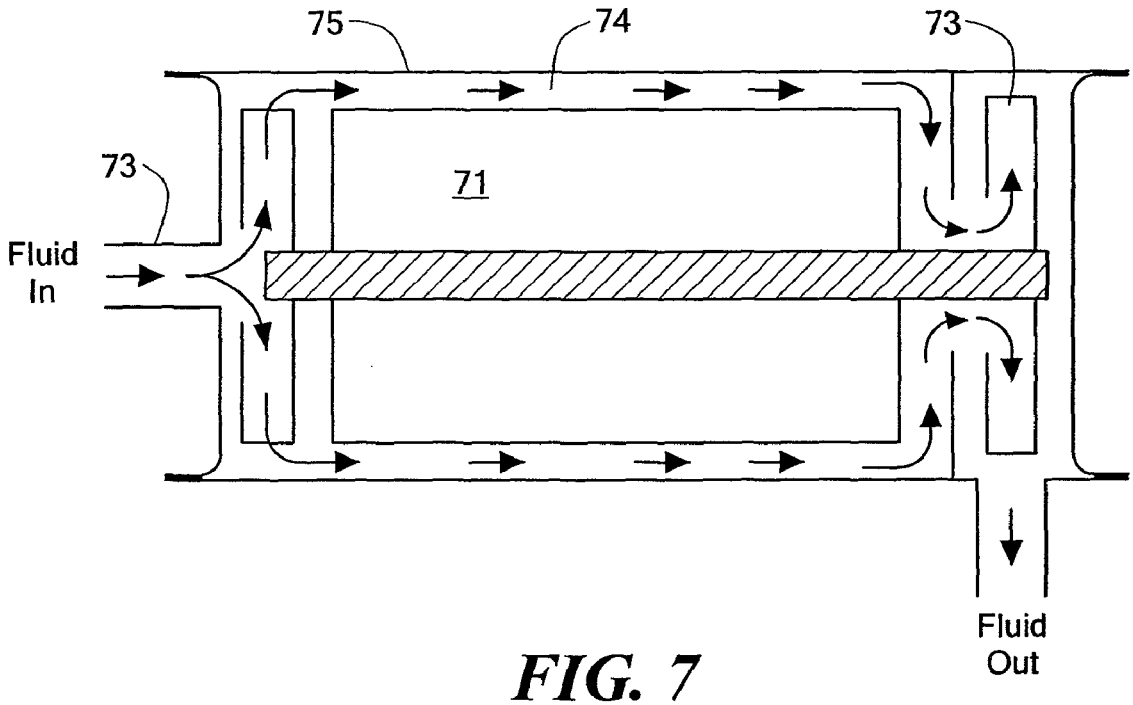
FIG. 7 is a side view of yet another embodiment in which coolant is conveyed between the motor housing and outer housing.

A further embodiment is shown in FIG. 7 wherein the pump includes an electrical motor 71 having an impeller 73 mounted on each motor shaft end and disposed within a sealed housing 75 as described above. In this case, coolant flowing into the inlet of the housing is caused to flow from the first impeller and through the annular space 74 between the motor housing and the pump housing to the second impeller and thence through the fluid outlet.

Figure 8:
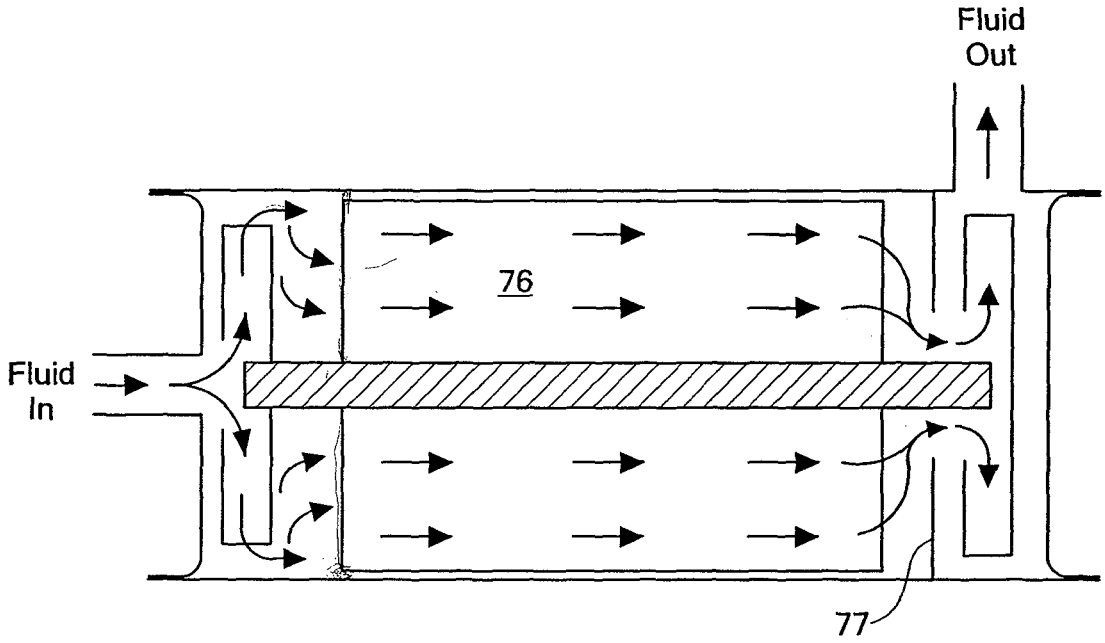
FIG. 8 is a side view of a further embodiment in which coolant is flowed through the motor housing.

Another embodiment is shown in FIG. 8 in which the motor 76 has openings or channels therethrough to permit the flow of coolant from the inlet through the motor case and then to the outlet of the pump housing. A baffle 77 can be provided to channel the coolant to the second impeller.

Figure 9:
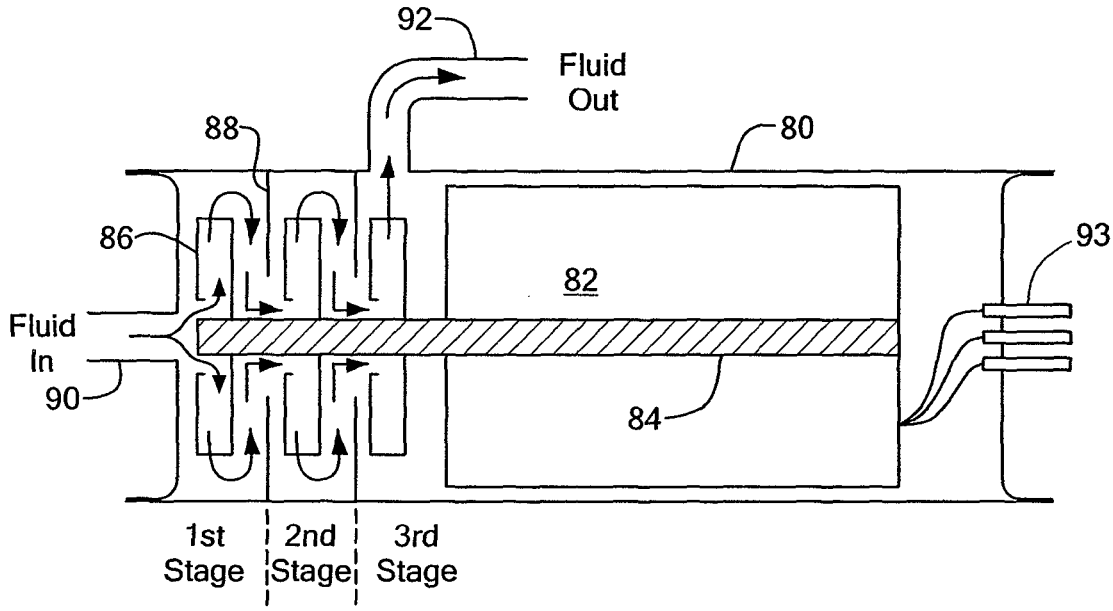
FIG. 9 is an alternative embodiment in which multiple impellers are provided on a single end of a motor shaft.

In a further alternative implementation, multiple impellers can be mounted on a single shaft end of the electrical motor. Referring to FIG. 9, there is shown a housing 80 having a motor 82 disposed therein and having a single extending motor shaft end 84. Three impellers 86 are mounted on the motor shaft end 84 and are rotatable therewith. Baffles 88 are provided between the impellers in the form of disks welded or otherwise attached to the interior wall of the housing and having central openings to accommodate the rotatable motor shaft and to channel coolant flowing between respective impellers. A coolant inlet 90 is provided at the end of the housing adjacent to the first impeller. A coolant outlet 92 is provided on the housing adjacent to the third impeller. Electrical leads 93 are hermetically sealed to the end cap for providing electrical connection to the motor. The motor bearings must be of sufficient strength to handle the added thrust of the multiple impellers on one end of the shaft.

Two or more impellers can be provided on a single ended motor shaft or on each end of a double ended motor shaft. The number of impellers is determined to provide an intended flow volume and pressure for a given motor size and speed.

Figure 10:
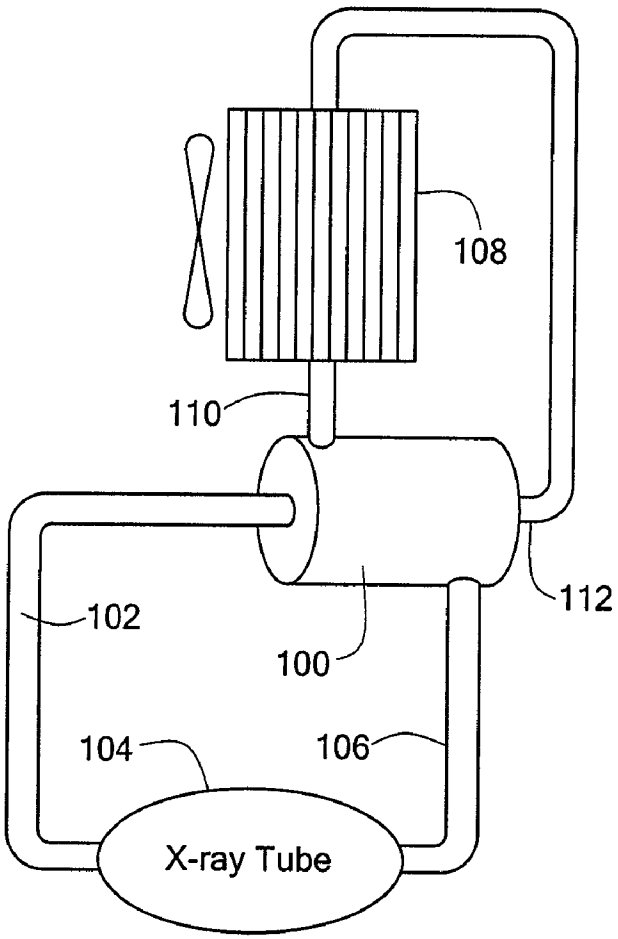
FIG. 10 is a diagrammatic illustration of an alternative X-ray tube cooling system having a multistage pump in accordance with invention.

An alternative system configuration is illustrated in FIG. 10. A multistage pump 100, which can be in accordance with the embodiments described above, has its input coupled by tubing 102 to X-ray tube housing 104 which is also connected via tubing 106 to the outlet of pump 100. The heat exchanger 108 is coupled between the outlet 110 of the first stage of the pump and the inlet 112 of the second stage of the pump. This arrangement reduces overall system pressure by providing a pressure rise in steps between the system components using a single pump. The pressure in the loop defined by tubing 110 and 112, and in the loop defined by tubing 102 and 106 is lower than the pressure in the single loop configuration such as shown in FIG. 1. As an example, coolant pressure of 25 psi is typical for the system of FIG. 1, whereas the coolant pressure in each loop of the system of FIG. 10 can be 12.5 psi.

Figure 11:
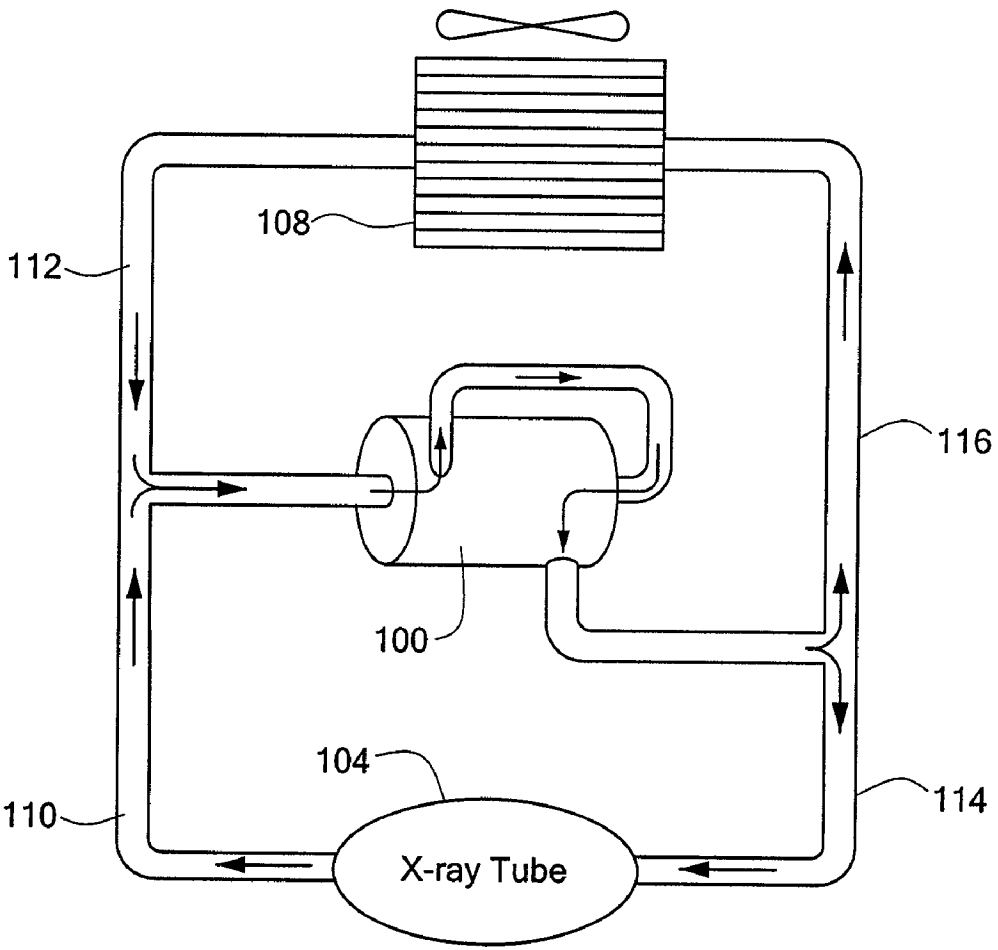
FIG. 11 is a diagrammatic illustration of a further X-ray tube cooling system having parallel coolant flow to the X-ray tube and the heat exchanger.

A further system configuration is shown in FIG. 11. The inlet of multistage pump 100 is coupled via tubing 110 to the X-ray tube housing 104 and via tubing 112 to heat exchanger 108. The outlet of pump 100 is coupled via tubing 114 to X-ray tube housing 104 and via tubing 116 to heat exchanger 108. Coolant from the pump follows parallel paths via tubing 114 and 116 to the X-ray tube housing and the heat exchanger and thence via tubing 110 and 112 to the inlet of the pump. This parallel flow arrangement allows each component of the system to receive the required coolant flow using a single pump. For example, the heat exchanger may not need the same flow rate as the X-ray tube, and the flow rate to each component of the system can be tailored to meet the cooling requirements of respective components. The tubing can be sized to obtain the intended pressure and flow, or valves can be used to obtain the pressure and flow.

The invention is not to be limited by what has been particularly shown and described and is intended to encompass the full spirit and scope of the appended claims.

What is claimed is:

1. A multistage sealed direct drive pump for pumping a liquid coolant comprising:

an electrical motor having a motor shaft;

a plurality of impellers mounted on said motor shaft;

a housing enclosing said electrical motor and said plurality of impellers, a first one of said plurality of impellers being located on a first end of said housing and a second one of said plurality of impellers being located on a second end of said housing, said housing having an inlet at said first end and an outlet at said second end; and a fluid conduit external to said housing and coupling said first end of said housing to said second end of said housing in order to provide fluid communication between a first of said plurality of impellers and a second of said plurality of impellers;

said electrical motor is submerged and in fluid communication with said liquid coolant in said housing; wherein said inlet, said fluid conduit external to said housing, and said outlet cooperate to define a fluid flow path for said liquid coolant to flow into said first end to said first one of said plurality of impellers, through said fluid conduit to said second end and said second one of said plurality of impellers, said housing being adapted to define a reservoir area for receiving said electrical motor and causing said electrical motor to be submerged in said liquid coolant associated with said second end of said housing, said reservoir area not being directly in said fluid flow path provided by the first conduit, said second one of said plurality of impeller being adjacent to said reservoir area and said first one of said plurality of impellers being separated from said reservoir area by a housing wall so that said liquid coolant cannot be impelled by said first one of said plurality of impellers to flow from said first end directly into said reservoir area, said second one of said plurality of impellers being adjacent to said reservoir area and impels fluid therein, wherein said reservoir area and said electrical motor are not directly in said fluid flow path so that all fluid flowing through said fluid conduit does not flow across said electrical motor.

2. The multistage sealed direct drive pump of claim 1 wherein said fluid is conveyed in the fluid flow path between impellers by one or more channels external to the housing.

3. The multistage sealed direct drive pump of claim 1 wherein the electrical motor has first and second motor shaft ends extending from respective ends of said electrical motor and to each of which at least one of the plurality of impellers is mounted.

* * * * *